US010260817B2

(12) United States Patent
Fetzer et al.

(10) Patent No.: US 10,260,817 B2
(45) Date of Patent: Apr. 16, 2019

(54) STACKED-PLATE HEAT EXCHANGER

(71) Applicant: Mahle International GmbH, Stuttgart (DE)

(72) Inventors: Tobias Fetzer, Ostfildern (DE); Florian Gall, Ditzingen (DE); Steffen Groezinger, Vaihingen (DE); Gabriel Gucanin, Stuttgart (DE); David Kenntner, Grand Rapids, MI (US); Volker Velte, Oetisheim (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/751,831

(22) PCT Filed: Aug. 3, 2016

(86) PCT No.: PCT/EP2016/068556
§ 371 (c)(1),
(2) Date: Feb. 9, 2018

(87) PCT Pub. No.: WO2017/025411
PCT Pub. Date: Feb. 16, 2017

(65) Prior Publication Data

US 2018/0231324 A1 Aug. 16, 2018

(30) Foreign Application Priority Data

Aug. 12, 2015 (DE) ..... 10 2015 215 410

(51) Int. Cl.
*F28D 9/00* (2006.01)
*F28F 3/08* (2006.01)
*F28D 21/00* (2006.01)

(52) U.S. Cl.
CPC ..... *F28D 9/0093* (2013.01); *F28D 9/005* (2013.01); *F28F 3/08* (2013.01); *F28D 2021/0082* (2013.01)

(58) Field of Classification Search
CPC ..... F28D 9/0093; F28D 9/0037; F28D 2021/0082; F28F 3/08; F28F 9/0075; F28F 21/084; F28F 2225/00; F28F 2275/04
See application file for complete search history.

(56) References Cited

U.S. PATENT DOCUMENTS 5,896,834 A * 4/1999 Gruner ..... F28D 9/005 123/196 AB
8,393,384 B2 3/2013 Velte et al.
(Continued)

FOREIGN PATENT DOCUMENTS

DE 102005044291 A1 3/2007
DE 102007010123 A1 9/2008
(Continued)

OTHER PUBLICATIONS

Eng. Abstract for FR-28343449.
Eng. Abstract for DE-102012222947.
Eng. Abstract for DE-102011078136.

*Primary Examiner* — Travis C Ruby
(74) *Attorney, Agent, or Firm* — Fishman Stewart PLLC

(57) ABSTRACT

A stacked-plate heat exchanger may include a first stacked-plate pack and a second stacked-plate pack. Each pack may have a plurality of stacked plates placed side by side and connected to one another, and a base plate via which at least one of inflow and outflow of a coolant may take place. The first and second stacked-plate packs may be connected to one another with the base plates lying against one another. The stacked-plate heat exchanger may also include a holder that holds the first and second stacked-plate packs exclusively on the two base plates. The first and second stacked-plate packs may each be directly connected to at least one of a coolant inlet and a coolant outlet via the respective base plates.

14 Claims, 3 Drawing Sheets

(56) References Cited

U.S. PATENT DOCUMENTS

| | | | | |
|---|---|---|---|---|
| 2005/0006544 | A1* | 1/2005 | Kaspar | F28F 9/002 248/300 |
| 2006/0131009 | A1* | 6/2006 | Nies | F28D 1/05391 165/176 |
| 2008/0264619 | A1* | 10/2008 | Velte | F28D 9/005 165/167 |
| 2010/0089342 | A1 | 4/2010 | Wegner et al. | |
| 2012/0210746 | A1* | 8/2012 | Kadle | F25B 1/00 62/498 |
| 2013/0201628 | A1* | 8/2013 | Aoki | F28D 1/0476 361/699 |
| 2014/0071622 | A1* | 3/2014 | Aoki | H01L 23/467 361/697 |

FOREIGN PATENT DOCUMENTS

| | | | |
|---|---|---|---|
| DE | 102011078136 | A1 | 12/2012 |
| DE | 102012222947 | A1 | 6/2014 |
| EP | 2784413 | A1 | 10/2014 |
| FR | 2843449 | A1 | 2/2004 |
| WO | WO-2010108907 | A1 | 9/2010 |

* cited by examiner

STACKED-PLATE HEAT EXCHANGER

CROSS-REFERENCE TO RELATED APPLICATIONS

This application claims priority to International Patent Application No. PCT/EP2016/068556, filed on Aug. 3, 2016, and German Patent Application No. DE 10 2015 215 410.6, filed on Aug. 12, 2015, the contents of both of which are incorporated herein by reference in their entireties.

TECHNICAL FIELD

The present invention relates to a stacked-plate heat exchanger. The invention relates in addition to an internal combustion engine with such a stacked-plate heat exchanger.

BACKGROUND

From DE 10 2005 044 291 A1 a generic stacked-plate heat exchanger, in particular a charge-air cooler, with a plurality of elongated plates, stacked on one another and connected to one another, in particular brazed, is known, which delimit a cavity for the directing through of a medium which is to be cooled, for example charge-air, in longitudinal direction of the plates, and a further cavity for the directing through of a coolant. The plates have here respectively an entry connection and an exit connection for the medium which is to be cooled. In order to be able to produce the stacked-plate heat exchanger at a favourable cost and in particular to construct it so as to be durable with regard to high temperatures, at least one coolant connection extends partially around a connection for the medium which is to be cooled.

Generally, in generic stacked-plate heat exchangers the problem always exists that these are connected, projecting far on one side over their base plate, to an internal combustion engine for example, whereby owing to the connection on one side and the large projection extent, large oscillations must be dissipated via the base plate, whereby the base plates themselves must be constructed so as to be comparatively heavy and thereby also expensive. The greater the desired performance of the stacked-plate heat exchanger here, the more stacked plates it must have and the stronger the associated base plate must be in its design.

SUMMARY

The present invention is therefore concerned with the problem of indicating for a stacked-plate heat exchanger of the generic type an improved or at least an alternative embodiment, which enables an improved connection in particular with regard to oscillations which occur.

This problem is solved according to the invention by the subject of the independent claim. Advantageous embodiments are the subject of the dependent claims.

The present invention is based on the general idea of no longer mounting a stacked-plate heat exchanger as known hitherto from the prior art in the manner of a cantilever arm exclusively at a longitudinal end and thereby having to receive large oscillations, but rather to realize a mounting via a distributor plate or respectively two base plates, which is/are arranged centrally, in particular in the middle of the stacked-plate heat exchanger. The stacked-plate heat exchanger according to the invention, which can be configured for example as a charge-air cooler of an internal combustion engine, has here a first and a second stacked-plate pack with in each case a plurality of stacked plates which are placed side by side and are connected to one another, in particular brazed, and a base plate, via which inflow and/or outflow of a coolant takes place. The two stacked-plate packs are connected to one another here and to a coolant inlet and/or a coolant outlet optionally directly via their base plates or indirectly via a distributor plate lying between the two base plates. Furthermore, the holding of the stacked-plate exchanger takes place via a holder which is connected to the distributor plate or respectively to the two centrally arranged base plates. Hereby, a central mounting of the stacked-plate heat exchanger according to the invention can be achieved, whereby the individual stacked-plate packs no longer project so far and thereby during operation of the internal combustion engine also do not oscillate so intensively, whereby basically also the two base plates themselves can be constructed so as to be thinner. In the stacked-plate heat exchanger according to the invention therefore for the first time a central mounting is created, which enables considerable advantages with regard to the oscillation behaviour and also with regard to the design of the base plate or respectively base plates of the stacked-plate heat exchanger.

In an advantageous further development of the solution according to the invention, the first stacked-plate pack is configured as a high temperature cooler and the second stacked-plate pack as a low temperature cooler. Hereby, for example, a charge-air flow can be cooled effectively for an internal combustion engine, by being directed firstly through the first stacked-plate pack configured as a high temperature cooler, subsequently through its base plate, the distributor plate and the base plate of the second stacked-plate pack and then through the second stacked-plate pack configured as a low temperature cooler. By the stacked-plate heat exchanger according to the invention therefore also a comparatively simple coupling of a high temperature cooler to a low temperature cooler is possible, wherein the supply of the two coolers with coolant takes place via the distributor plate which is arranged therebetween.

Expediently, distributor channels, both a coolant inlet and a coolant outlet for the first stacked-plate pack and also a coolant inlet and a coolant outlet for the second stacked-plate pack are provided in the distributor plate. An inflow and outflow of coolant into the two stacked-plate packs thereby takes place exclusively via the substantially centrally arranged distributor plate, wherein of course, depending on the desired performance of the first and of the second stacked-plate pack, these can be of equal size or else can have a different size and thereby a different performance. Through the coupling both of the coolant inlet and also of the coolant outlet for both stacked-plate packs in the distributor plate also hitherto separately arranged coolant ducts are superfluous, whereby the stacked-plate heat exchanger as a whole can be constructed at a more favourable cost.

In an alternative embodiment of the solution according to the invention, both a coolant inlet or a coolant outlet for the first stacked-plate pack and also a coolant inlet or a coolant outlet for the second stacked-plate pack are provided in the distributor plate. Again alternatively, a coolant inlet for the first stacked-plate pack and a coolant outlet for the second stacked-plate pack or respectively a coolant outlet for the first stacked-plate pack and a coolant inlet for the second stacked-plate pack can also be provided in the distributor plate. This non-exclusive list of different arrangement possibilities of the coolant inlets and outlets of the two stacked-plate packs already suggests what great flexibility can be guaranteed in the production of the stacked-plate heat exchanger according to the invention.

In a further advantageous embodiment of the solution according to the invention, the first and the second stacked-plate pack has respectively a cover plate with a passage for the medium which is to be cooled, in particular for exhaust gas which is to be cooled. In this case, the stacked-plate heat exchanger is thereby flowed through orthogonally to the stacked-plate planes by the medium which is to be cooled, wherein of course in the first stacked-plate pack and/or in the second stacked-plate pack also a deflection of the medium which is to be cooled, for example of the exhaust gas which is to be cooled, parallel to the respective stacked plates, is possible.

In a further advantageous embodiment of the solution according to the invention, the stacked plates, the base plates and/or the distributor plate is/are made from brazeable aluminium. Aluminium has a comparatively high coefficient of thermal conductivity and is, in addition, comparatively light, whereby it is particularly advantageous for the use of a charge-air cooler in an internal combustion engine of a motor vehicle.

The present invention is further based on the general idea of using in an internal combustion engine a previously described stacked-plate heat exchanger as charge-air cooler, whereby in particular a connection of the stacked-plate heat exchanger which is optimized with regard to oscillation is made possible.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown here, respectively diagrammatically.

DETAILED DESCRIPTION

Figure 1:
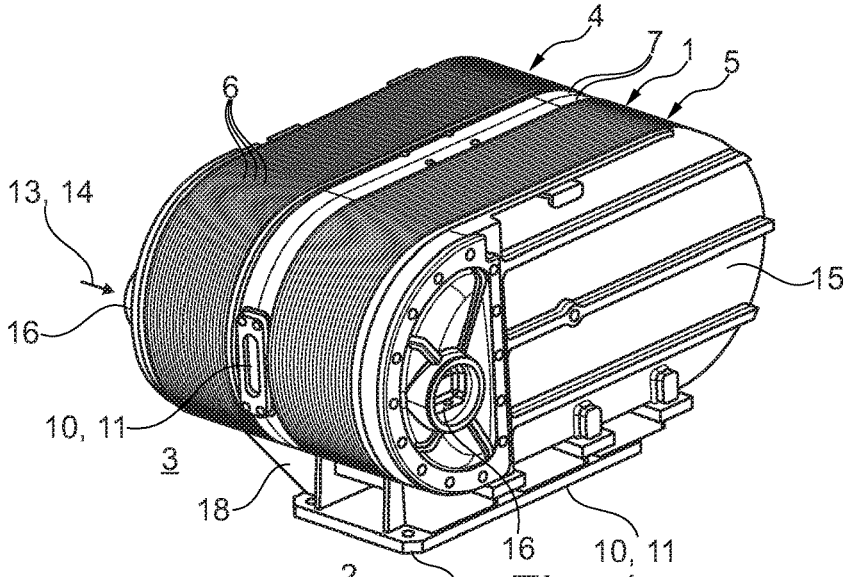
FIG. 1 a stacked-plate heat exchanger according to the invention, in an oblique view, FIG. 2 an illustration as in FIG. 1, but in a front view, FIG. 3 a side view onto the stacked-plate heat exchanger according to the invention, FIG. 4 a further possible embodiment of the stacked-plate heat exchanger according to the invention, FIG. 5 a detail illustration of the holder, FIG. 6 a further possible embodiment of the stacked-plate heat exchanger according to the invention, but with only indicated holder.
Figure 2:
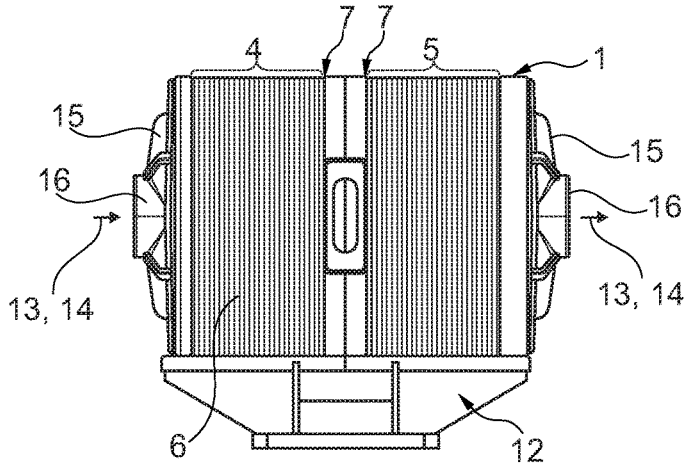
Figure 3:
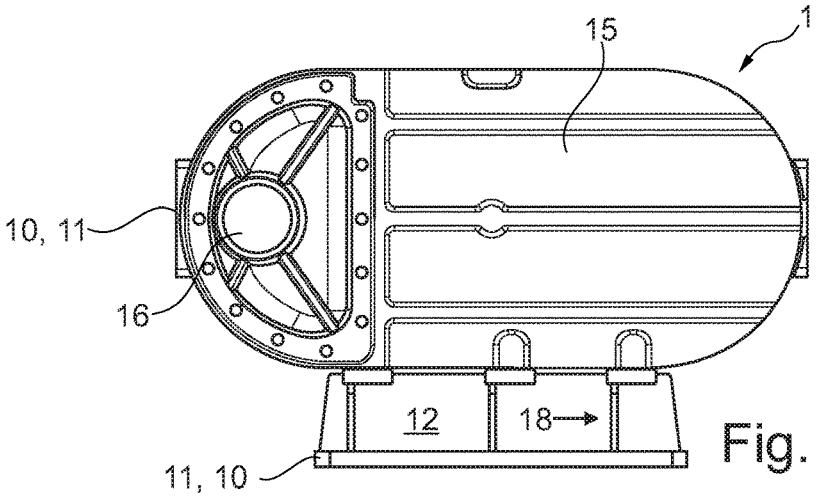
Figure 4:
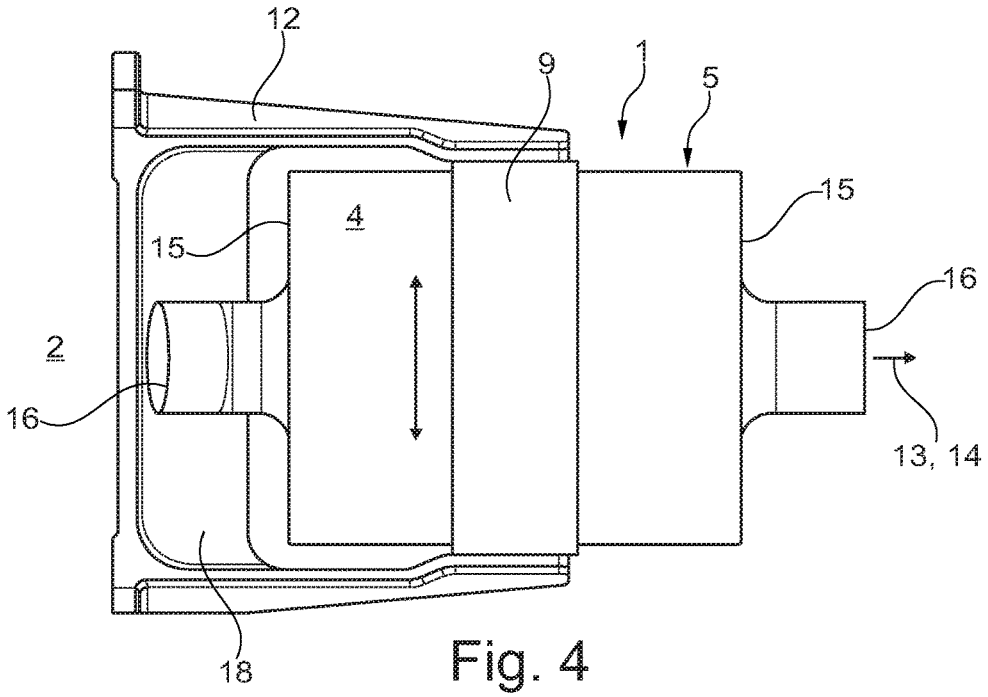
Figure 5:
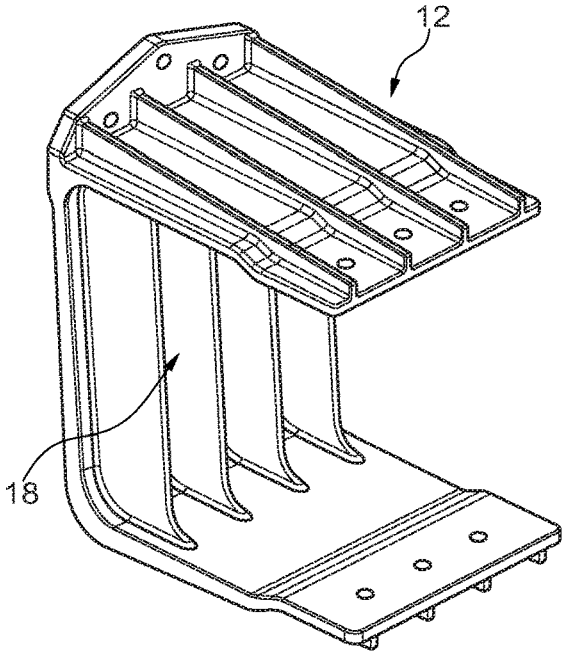

According to FIGS. 1-4 and 6, a stacked-plate heat exchanger 1 according to the invention, which can be configured in particular as a charge-air cooler of an internal combustion engine 2 in a motor vehicle 3, has a first stacked-plate pack 4 and a second stacked-plate pack 5 with in each case a plurality of stacked plates 6 which are placed side by side and are connected to one another, in particular brazed to one another, and respectively a base plate 7, via which inflow and/or outflow of a coolant 8 takes place. According to the invention, the two stacked-plate packs 4, 5 are connected to one another and to a coolant inlet 10 and/or a coolant outlet 11 via a distributor plate 9 lying between the two base plates 7 (cf. FIGS. 6 and 7). Alternatively hereto, it is also conceivable that the two stacked-plate packs 4, 5 are connected to one another via their respective base plate 7, wherein these two base plates 7 then together form the distributor plate 9 and likewise have a coolant inlet 10 and/or a coolant outlet. Furthermore, a holder 12 is provided, which holds the stacked-plate heat exchanger 1 exclusively centrally, i.e. in particular at the two base plates 7 or respectively at the distributor plate 9 and thereby fixes centrally the stacked-plate pack 4, 5 projecting respectively from the base plate 7. Hereby, compared to a stacked-plate heat exchanger known from the prior art, in which the entire stacked-plate pack is suspended on a base plate only on one side in the manner of a cantilever arm, considerably lower oscillation stresses can be achieved, owing to the shorter stacked-plate packs 4, 5 according to the invention, whereby on the one hand both the base plates 7 have to be constructed for example to be less rigid and therefore also less heavy, and in addition external pipelines, which were often necessary in the case of a connection on one side, can be avoided.

Figure 6:
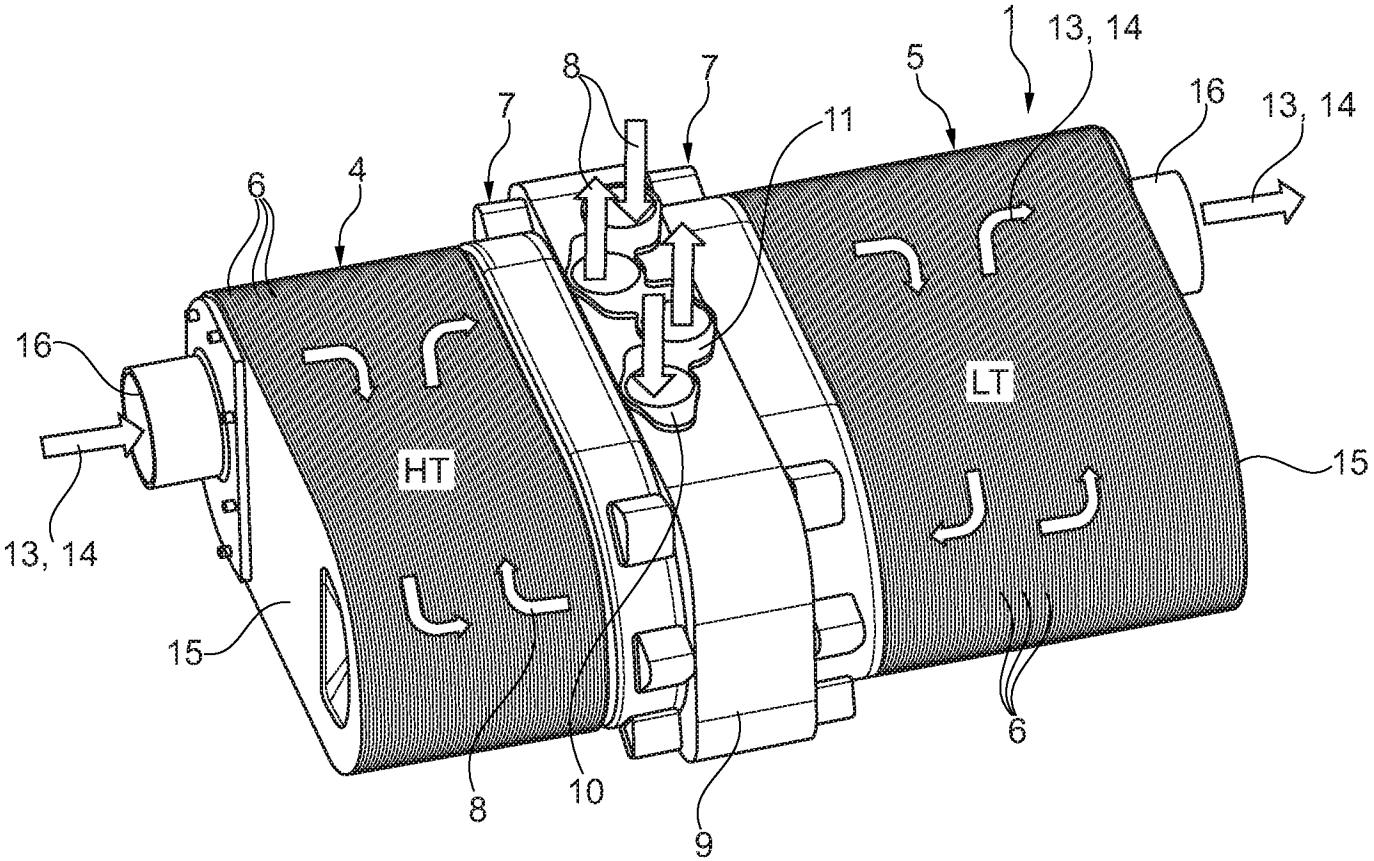

Observing now, for example, the stacked-plate heat exchanger 1 according to FIG. 6, it can be seen there that the first stacked-plate pack 4 is configured as a high temperature cooler (HT) and the second stacked-plate pack 5 is configured as a low temperature cooler (LT).

In the distributor plate 9 or respectively in the two base plates 7 forming this distributor plate 9, both a coolant inlet 10 and a coolant outlet 11 for the first stacked-plate pack 4 and also a coolant inlet 10 and a coolant outlet 11 for the second stacked-plate pack 5 can be provided here for example (cf. FIG. 6). Alternatively hereto, provision can also be made that in the distributor plate 9 or respectively in the two cooling plates 7 forming this distributor plate 9, both a coolant inlet 10 or a coolant outlet 11 for the first stacked-plate pack 4 and also a coolant inlet 10 or a coolant outlet 11 for the second stacked-plate pack 5 are provided. In the distributor plate 9 or respectively in the two base plates 7 alternatively likewise also a coolant inlet 10 for the first stacked plate pack 4 and a coolant outlet 11 for the second stacked plate pack 5 or vice versa can be provided. In the distributor plate 9 or respectively in the two base plates 7, channels, not described here in further detail, are arranged for a medium 13 which is to be cooled, for example exhaust gas 14, and for coolant 8.

Observing the embodiments according to FIGS. 1-4 and 6, it can be seen furthermore that the first and second stacked-plate pack 4, 5 respectively has a cover plate 15 with a passage 16 for the medium 13 which is to be cooled, in particular for the exhaust gas 14 which is to be cooled. The stacked plates 6 themselves or respectively the base plates 7 and/or the distributor plate 9 can be made here from a material which is light and at the same time has good heat-conducting properties, such as for example brazeable aluminium.

An internal combustion engine 2 of a motor vehicle 3 equipped with the stacked-plate heat exchanger 1 according to the invention offers the great advantage that a mounting which is optimized with regard to oscillations is possible, because the originally one-part stacked-plate pack has now been divided into two stacked plates 4, 5 and thereby the respectively projecting part of the stacked-plate pack 4, 5 is only approximately half as large as in the stacked-plate packs connected on one side, known from the prior art. Hereby in particular also the base plates 7 or respectively the distributor plate 9 can be designed to be lighter and thereby at a more favourable cost. The two stacked-plate packs 4, 5 can be substantially equal in size here or else can have a different size, in particular in so far as for example a high temperature cooler is to be have a higher or lower performance than a downstream low temperature cooler. A connection between the two base plates 7 or respectively between these and the distributor plate 9 is brought about for example by means of screws 17 (cf. FIG. 6).

In order to be able to achieve as rigid a connection as possible of the stacked-plate heat exchanger 1 to the internal combustion engine 2, the holder 12 which is used for this can have reinforcement ribs 18 (cf. FIG. 1-5), wherein the holder 12 can be screwed to the stacked-plate heat exchanger 1. Purely theoretically, even a guiding of a coolant duct within the holder 12 is conceivable.

The invention claimed is:

1. A stacked-plate heat exchanger, comprising:

a first stacked-plate pack and a second stacked-plate pack, each pack including a plurality of stacked plates and a base plate via which at least one of inflow and outflow of a coolant takes place, the plurality of stacked plates being placed side by side and connected to one another;

a distributor plate lying between the base plates, the distributor plate including a coolant inlet and a coolant outlet for the first stacked-plate pack, and a coolant inlet and a coolant outlet for the second stacked-plate pack; and a holder that holds the first and second stacked-plate packs;

wherein the first and second stacked-plate packs are each indirectly connected to the respective coolant inlet and coolant outlet via the distributor plate.

2. The stacked-plate heat exchanger according to claim 1, wherein the first stacked-plate pack is configured as a high temperature cooler, and the second stacked-plate pack is configured as a low temperature cooler, where a temperature of a charge-air flow is higher through the high temperature cooler than through the low temperature cooler.

3. The stacked-plate heat exchanger according to claim 2, wherein the first and the second stacked-plate packs each has a cover plate with a passage for a medium, which is to be cooled.

4. The stacked-plate heat exchanger according to claim 2, wherein the plurality of stacked plates and the base plate of each of the first and second stacked-plate packs are formed from brazeable aluminium.

5. The stacked-plate heat exchanger according to claim 1, wherein the first and the second stacked-plate packs each has a cover plate with a passage for a medium, which is to be cooled.

6. The stacked-plate heat exchanger according to claim 1, wherein the plurality of stacked plates and the base plate of each of the first and second stacked-plate packs are formed from brazeable aluminium.

7. The charge-air cooler according to claim 1, wherein the holder includes reinforcement ribs.

8. The charge-air cooler according to claim 1, wherein the holder is connected to the distributor plate.

9. An internal combustion engine, comprising a stacked-plate heat exchanger configured as a charge-air cooler, the stacked-plate heat exchanger having:

a first stacked-plate pack and a second stacked-plate pack, each pack including a plurality of stacked plates and a base plate via which at least one of inflow and outflow of a coolant takes place, the plurality of stacked plates being placed side by side and connected to one another;

a distributor plate lying between the base plates, the distributor plate including a coolant inlet and a coolant outlet for the first stacked-plate pack, and a coolant inlet and a coolant outlet for the second stacked-plate pack; and a holder that holds the first and second stacked-plate packs;

wherein the first and second stacked-plate packs are each indirectly connected to the respective coolant inlet and coolant outlet via the distributor plate.

10. The internal combustion engine according to claim 9, wherein the first stacked-plate pack is configured as a high temperature cooler, and the second stacked-plate pack is configured as a low temperature cooler.

11. The internal combustion engine according to claim 9, wherein the first and the second stacked-plate packs each has a cover plate with a passage for a medium.

12. The internal combustion engine according to claim 9, wherein the plurality of stacked plates and the base plate of each of the first and second stacked-plate packs are formed from brazeable aluminium.

13. A charge-air cooler comprising:

a first stacked-plate pack configured as a high temperature cooler, and a second stacked-plate pack configured as a low temperature cooler, each pack including:

a plurality of stacked plates placed side by side and connected to one another, a base plate via which at least one of inflow and outflow of a coolant takes place, the first and second stacked-plate packs being connected to one another ; and a cover plate with a passage for exhaust gas, which is to be cooled;

a distributor plate lying between the base plates, the distributor plate including a coolant inlet and a coolant outlet for the first plate pack, and a coolant inlet and a coolant outlet for the second plate pack; and a holder that holds the first and second stacked-plate packs;

wherein the first and second stacked-plate packs are each indirectly connected to the respective coolant inlet and coolant outlet via the distributor plate.

14. The charge-air cooler according to claim 13, wherein the plurality of stacked plates and the base plate of each of the first and second stacked-plate packs are formed from brazeable aluminium.

* * * * *